US006135440A

United States Patent [19]

Lynch et al.

[11] Patent Number: 6,135,440

[45] Date of Patent: Oct. 24, 2000

[54] SHEET FEEDING APPARATUS

[75] Inventors: Andrew Lynch; David J. McMillan; John A. Peebles, all of Dundee, United Kingdom

[73] Assignee: NCR Corporation, Dayton, Ohio

[21] Appl. No.: 09/023,473

[22] Filed: Feb. 13, 1998

[30] Foreign Application Priority Data

May 30, 1997 [GB] United Kingdom ..... 9711071

[51] Int. Cl.[7] ..... B65H 3/04

[52] U.S. Cl. ..... 271/34; 271/118; 271/121; 271/122; 271/149; 902/14

[58] Field of Search ..... 271/118, 34, 35, 271/10.03, 110, 94, 96, 31.1, 114, 116, 122, 121, 125, 149, 119, 111; 221/13, 21, 259, 277; 982/14, 15, 17

[56] References Cited

U.S. PATENT DOCUMENTS

| | | | |
|---|---|---|---|
| 4,159,782 | 7/1979 | Swartzendruber | 221/21 |
| 5,219,154 | 6/1993 | Fukube et al. | 271/34 |
| 5,234,208 | 8/1993 | Bandura et al. . | |
| 5,257,777 | 11/1993 | Kalika et al. . | |
| 5,301,834 | 4/1994 | Lee et al. | 221/129 |
| 5,441,248 | 8/1995 | Kristola | 271/94 |
| 5,743,429 | 4/1998 | Morofsky | 271/118 |

FOREIGN PATENT DOCUMENTS

| | | | |
|---|---|---|---|
| 0329296 | 8/1989 | European Pat. Off. . | |
| 1285484 | of 0000 | Germany . | |
| 4217618 | 3/1995 | Germany . | |
| 0197238 | 8/1989 | Japan | 271/34 |
| 405032327 | 2/1993 | Japan | 271/35 |

OTHER PUBLICATIONS

Hetting, Document Feed Metering Device, IBM Technical Disclosure Bulletin vol. 5, No. 8, Jan. 1963, pp. 21–23.

*Primary Examiner*—H. Grant Skaggs
*Attorney, Agent, or Firm*—Gregory A. Welte

[57] ABSTRACT

A belt (28) is moved into contact with a sheet (70) to be fed from the stack (18) under the control of a solenoid (48), which when energized causes pivoting of a crank mechanism (42) and an pulley (26) which supports the belt (28). The belt (28) frictionally engages the sheet (70) as to separate it from the stack (18) and move it into engagement with feed rollers (56) of a transport mechanism. The belt (28) is then retracted from the sheet (70) which is moved away from the stack (18) by the feed rollers (56). After a predetermined time period, the belt (28) is moved into contact with the next sheet of the stack (18) to be fed and the process is repeated until the desired number of sheets have been fed from the stack (18). The belt (28) is driven so that it rotates continuously during the pick operation and is brought to rest on retraction of the belt (28) after the final sheet has been picked from the stack (18).

5 Claims, 3 Drawing Sheets

SHEET FEEDING APPARATUS

BACKGROUND OF THE INVENTION

The present invention relates to a sheet feeding apparatus for picking sheets one by one from a stack of sheets, and moving the picked sheets away from the stack.

Sheet feeding apparatus of this kind are commonly of either the vacuum pick or friction pick type. Vacuum pick systems use a suction member to separate the first sheet from the rest of the stack and are particularly suitable for handling sheets which are nonporous, such as currency notes in an automated teller machine (ATM). Friction type pick systems are also commonly used in ATMs. Some friction pick systems are advantageous in that they have higher feed rate capabilities than vacuum type systems and are of relatively simple construction. In addition to picking currency notes, sheet feeding apparatus of the vacuum pick or friction pick type may be used for picking other types of sheets from a stack, such as photocopier sheets, tickets, vouchers, sheets of stamps, travelers cheques etc.

Friction pick systems commonly use a rotating pick roller having a high friction material disposed over its entire outer peripheral surface or over a localized area thereof. When the pick roller makes contact with a first sheet of a stack, the frictional force exerted on the sheet is greater than the frictional force between this sheet and the next sheet in the stack, which causes the first sheet to be separated from the stack and moved away by the rotating roller. However, the high friction surfaces on the picker roller tend to become worn relatively quickly and need to be replaced. This is inconvenient and expensive, as frequent maintenance of the feeding system is required. Moreover, the reliability of the feeding system is reduced as the friction surface becomes progressively worn.

Rotating friction belts have also been used in friction pick systems to pick sheets from a stack and in general are less susceptible to wear than friction rollers. Since the rotating belt presents a larger friction surface than a pick roller and the portion of the belt which engages the stack is constantly changing, wear of the belt tends to be spread over the length of the belt rather than on a localized area thereof. A known pick apparatus having friction belt means is disclosed in EP-A-0329 296. This known apparatus has a driven belt for delivering sheets from a stack, where the belt is brought into contact with the bottom sheet of a stack of sheets at the commencement of a pick operation and is retracted therefrom when the leading edge of the bottom sheet has been moved into engagement with feed rollers which carry the picked sheet away from the stack. Since the time in which the belt is in contact with the stack of sheets during a picking operation is minimal, such an arrangement is advantageous with respect to wear of the belt. However, the apparatus has the disadvantage that it has a limited feed rate capacity, since the belt is decelerated and brought to rest after each pick operation and therefore is not suitable for many applications. A further disadvantage of this apparatus is that the mechanism used to achieve shifting of the belt is complex, involving cams, levers and lifting bars.

SUMMARY OF THE INVENTION

It is an object of the present invention to provide a sheet feeding apparatus of the friction pick type which is highly tolerant to wear and in which the disadvantages of the known apparatus referred to above are alleviated.

According to the present invention there is provided a sheet feeding apparatus for picking a selected number of sheets one by one from a stack in the course of a pick operation, comprising belt means arranged to frictionally engage the first sheet of the stack and move the sheet into engagement with feed means which is arranged to move the sheet away from the stack, characterized by drive means for continuously rotating the belt means during a pick operation, pivotably mounted support means in permanent supporting engagement with the belt means, and control means for controlling pivotal movement of the support means, whereby the belt means is moved into engagement with the sheet to be fed and is retracted therefrom, prior to being moved into engagement with the next sheet of the stack to be fed.

BRIEF DESCRIPTION OF THE DRAWINGS

One embodiment of the invention will now be described by way of example with reference to the accompanying drawings, in which.

DETAILED DESCRIPTION

Figure 1:
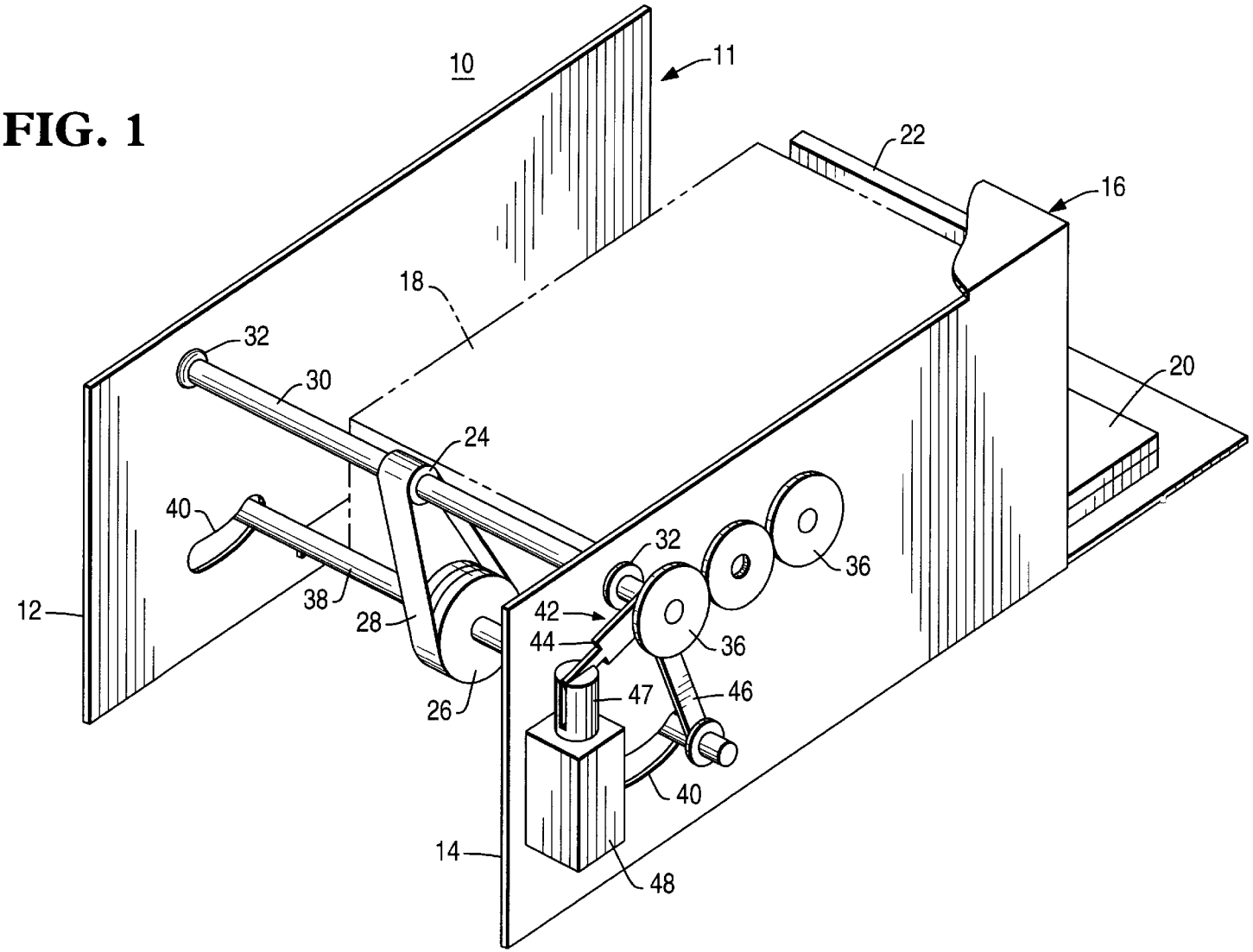
FIG. 1 is a perspective view of a sheet pick mechanism embodying the present invention, the mechanism serving to pick currency notes from an associated currency cassette.
Figure 2:
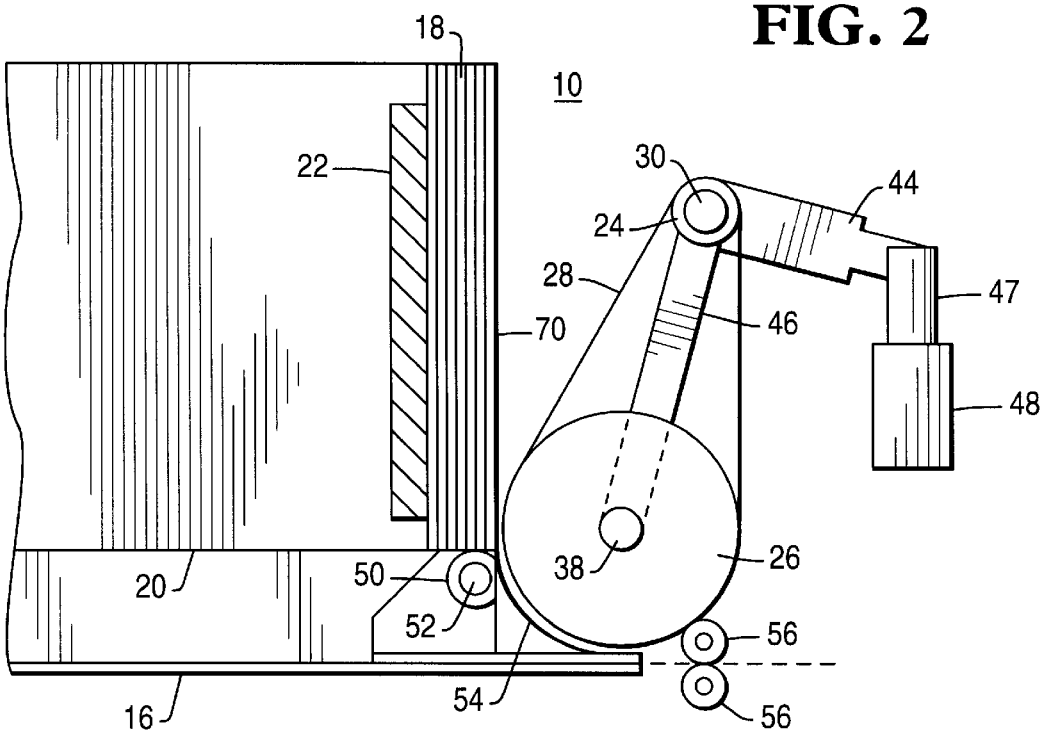
FIG. 2 is a side view of a sheet feeding apparatus including the pick mechanism of FIG. 1, the view being taken from the left hand side of FIG. 1 and the pick mechanism being shown in a picking position.
Figure 3:
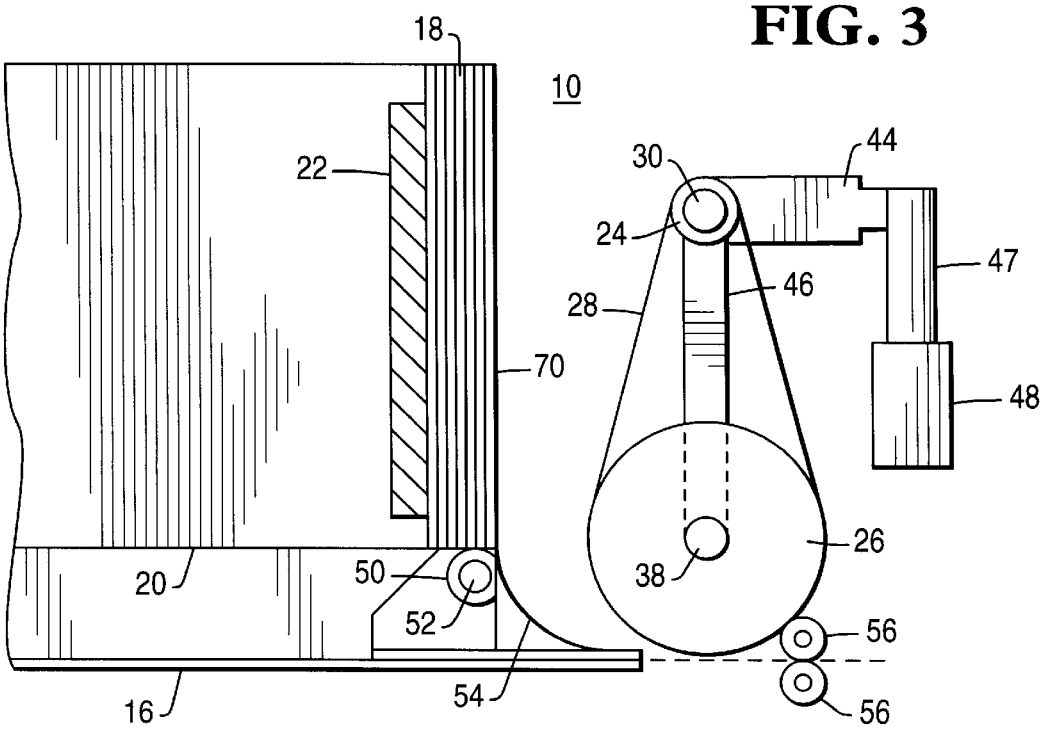
FIG. 3 is a view similar to FIG. 2 except that the pick mechanism is shown in an idle position.

Referring to FIGS. 1 to 3, the sheet feeding apparatus shown therein includes a pick mechanism 10 having a frame 11 (not shown in FIGS. 2 and 3) including two vertically extending side plates 12 and 14, mounted in parallel spaced apart relation to each other. The frame 11 serves to support the various drive mechanisms and other components of the sheet feeding apparatus, as will be described hereafter. A currency cassette 16 containing a stack of currency notes 18, is removably mounted in the frame 11 between the two side plates 12 and 14. The notes in the stack 18 are supported by a base plate 20 of the cassette 16, with the notes being disposed vertically with corresponding long edges being in engagement with the base plate 20. The stack of notes 18 is resiliently biased in a forward direction (from left to right with reference to FIGS. 2 and 3) by a pusher plate 22 which is urged against the rear of the stack of notes 18 by an arrangement of return springs (not shown).

The mechanism 10 includes a drive pulley 24 and a pick pulley 26 which support, and around which passes an endless belt 28 of a high friction material such as a modified rubber. The drive pulley 24 is secured on a drive shaft 30 which extends between two bearing means 32 which are respectively supported by the side plates 12 and 14 of the frame 11. The drive shaft 30 of the drive pulley 24 is driven by an electric motor 34 (FIG. 5), via a gearing mechanism 36 mounted on the side plate 14 of the frame 11. The pick pulley 26 is rotatably mounted on a shaft 38 which extends through elongated arcuate slots 40 provided in the side plates 12 and 14. A bell crank 42 is pivotally mounted on one end of the drive shaft 30 of the drive pulley 24 and is arranged for pivotal movement about the axis thereof. A first arm 44 of the bell crank 42 is pivotally coupled to an armature 47 of a solenoid 48 which is mounted on the side plate 14 of the frame 11, while a second arm 46 of the bell crank 42 is secured to one end of the shaft 38 of the pick pulley 26 and is arranged to support the shaft 38. The other end of the shaft 38 is supported by one end of an arm (not shown), the other end of which is secured to that end of the shaft drive 30 remote from the bell crank 42.

A retard roller 50 (not shown in FIG. 1) is provided in cooperative association with the belt 28 and pick roller 26, to prevent the feeding of two or more notes simultaneously. The retard roller 50 has an outer annular portion of rubber having a coefficient of friction which is lower than that of the friction belt 28 and is coupled to the output shaft 52 of a motor 53 (FIG. 5), to be rotated thereby. A guide plate 54 having a curved guide surface extends from adjacent the nip formed between the belt 28 and the retard roller 50 and serves to guide notes which have been picked from the stack 18 towards the feed rollers 56 of a transport mechanism. For simplicity, only one pair of feed rollers 56 are shown in FIGS. 2 and 3, but it should be understood that the transport mechanism is of conventional design and typically includes a plurality of pairs of feed rollers 56 which move notes which have been picked away from the cassette 16. A sensor 72 (FIG. 5) is positioned adjacent the first pair of feed rollers 56 so as to detect when the leading edge of a note has been engaged by the feed rollers 56.

Figure 5:
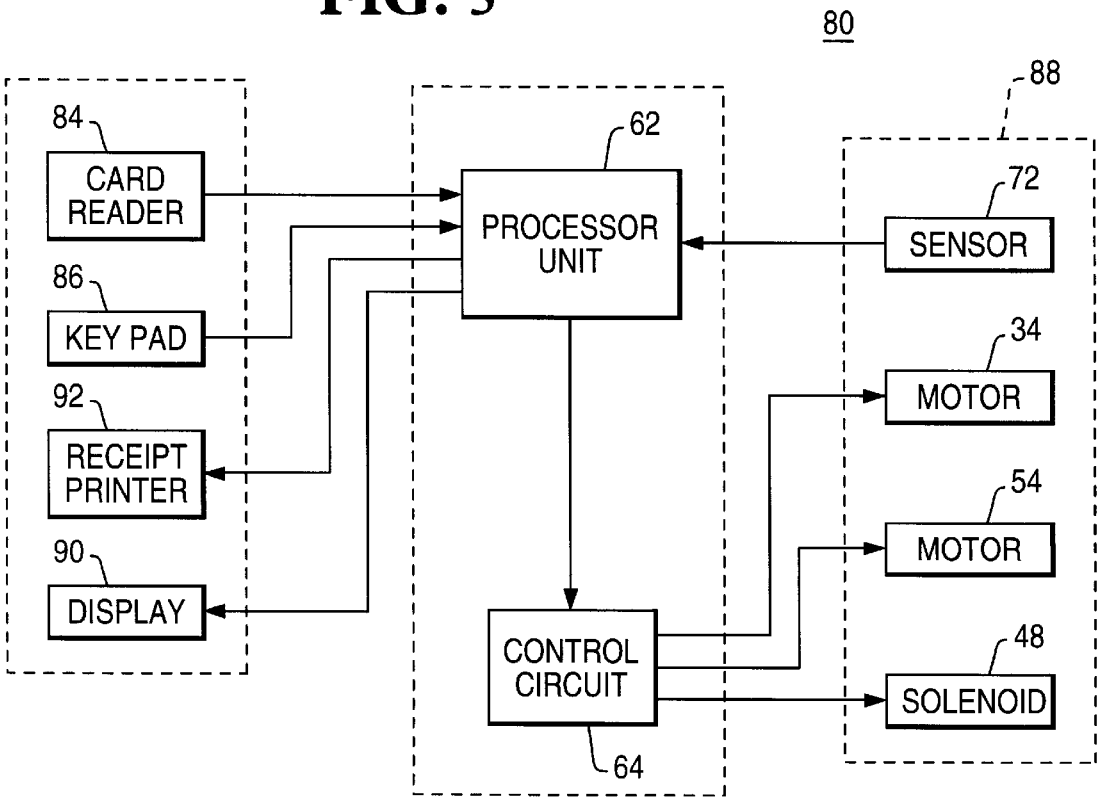
FIG. 5 is a block diagram representation of the ATM of FIG. 4.

The various mechanisms within the sheet feeding apparatus shown in FIGS. 1 to 3 are controlled by a processor unit 62 and a control circuit 64 (FIG. 5). The processor unit 62 may include a microcomputer and communicates with the control circuit 64 which provides the control of power to the motor 34 (FIG. 5) of the drive shaft 30, the motor 53 (FIG. 5) of the retard roller shaft 50, the solenoid 48, and the sensor 72 (FIG. 5), and also provides timing control.

Also, it should be understood that, although only one belt 28 and associated pulleys 24 and 26 have been illustrated and described with reference to FIGS. 1 to 3, in practice, two or more belts 28 and associated drive and pick pulleys (24, 26) could be provided, with each drive pulley 24 being secured on the drive shaft 30, and a separate retard roller 50 being cooperatively associated with each belt 28.

The operation of the above-described apparatus for picking notes will now be described with continuing reference to FIGS. 1, 2 and 3. In an idle condition, i.e. when no pick operation request has been received by the processor unit 62, the friction belt 28 and pick pulley 26 are in a position separated from the stack of notes 18, as is illustrated in FIG. 3.

When a pick operation request is received by the processor unit 62, activation signals are sent by the control circuit 64 to the motor 34 of the drive shaft 30, the solenoid 48 and to the drive motor 53 of the retard roller 50. The pick operation request may be a single note command, in which case only one pick cycle is to be carried out, or a multiple note command, in which case successive pick cycles are to be carried out until the desired number of notes have been picked from the cassette 16. The motor 34 drives the shaft 30 via the gearing mechanism 32 causing the drive pulley 24 and the friction belt 28 to rotate. As the friction belt 28 is driven, the pick pulley 26 is caused to rotate about the axis of the shaft 38.

Normally, the pick mechanism 10 is held in the idle condition shown in FIG. 3 under the action of spring means (not shown) connected to the bell crank 42. On energization of the solenoid 48, the arm 44 of the bell crank 42 pivots in a clockwise direction (with reference to FIGS. 2 and 3) from the idle position of the pick mechanism 10 to the picking position shown in FIG. 2. This causes the shaft 38 to slide along the elongated arcuate slots 40 provided in the side plates 12 and 14, so that the pick pulley 26 moves towards the stack of notes 18 and a portion of the rotating friction belt 28 passing around the pick pulley 26 makes contact with the first note 70 of the stack 18.

The pusher plate 22 is urged against the rear of the stack 18, biasing it towards the pick pulley 26. The rotating friction belt 28 engages the first note 70 of the stack 18, separating it from the rest of the stack 18 and moves the picked note 70 into the nip between the belt 28 and the retard roller 50. The picked note 70 continues to be moved away from the stack 18 and is guided by the guide plate 54 until the leading edge of the sheet 70 is gripped between the first pair of feed rollers 56 of the transport mechanism. A sensor 72 (FIG. 5) senses when the leading edge of the picked note 70 is gripped between the first pair of feed rollers 56 and sends a signal to the processor unit 62. The feed rollers 56 of the transport mechanism then carry the note 70 away from the stack 18 to a remote stacking or collection point.

The retard roller 50 is driven to rotate in the opposite direction to, and at a significantly lower speed than, the belt 28 and engages the rear surface of the picked sheet 70 as it is moved by the belt 28 through the nip between the retard roller 50 and the belt 28. The frictional force exerted by the belt 28 on the front side of the note 70 is greater than the frictional force exerted by the retard roller 50 in the opposite direction on the rear side of the note 70. In the event that more than a single note is picked from the stack 18 and passes into the nip, the difference in speed and direction of rotation of the belt 28 and the retard roller 50 which engage opposed surfaces of the superposed notes, causes separation of notes from one another. The first note continues to be moved by the belt 28 towards the feed rollers 56, while the other note or notes are restrained by the retard roller 50 from being fed through the nip between the retard roller 50 and the belt 28.

The solenoid 48 is controlled by the control circuit 64 to remain in an energized state until a signal is received by the processor unit from the sensor 72, on detection of the leading edge of the picked note 70 being gripped by the feed rollers 56 of the transport mechanism. The solenoid is de-energized in response to the signal from the sensor 72, and the bell crank 42 pivots in an anticlockwise direction (with reference to FIGS. 2 and 3) under the action of the associated spring means (not shown), causing the shaft 38 of the pick pulley 26 to slide outwardly along the elongated arcuate slots 40, so that the belt 28 is no longer in contact with the stack of notes 18, as is shown in FIG. 3.

If a pick operation request for a single note is received by the processor unit 62, the pick operation is now complete and the motors 34 and 53 of the drive shaft 30 and the retard roller 50 are de-energized by the control circuit 64 until a subsequent pick operation request is received by the processor unit 62.

If a multiple note pick operation request was received by the processor unit 62, multiple pick cycles are required in order to complete the pick operation. In such a case the motors 34 and 53 are maintained in an energized condition by the control circuit 64 after completion of the first pick cycle. After a predetermined time period has elapsed, the solenoid 48 is re-energized by the control circuit 64. This time period is sufficiently long to allow the belt 28 to be retracted from the stack of notes 18 after de-energization of the solenoid, and for the trailing edge of the previously picked note to have been moved away from the stack of notes 18. On re-energization of the solenoid 48, the belt 28 is brought back into contact with the stack 18 and the next first note 70 of the stack 18 is picked therefrom in the manner described above. The belt 28 is again retracted from the stack 18 on the receipt by the processor unit 62 of a signal from sensor 72 when the leading edge of the picked note 70 has been gripped by the first pair of feed rollers 56, and the process is repeated until the desired number of noted sheets have been fed from the stack 18. When the belt 28 has been retracted after the final pick cycle, the motors 34 and 53 are de-energized by the control circuit 64 and the belt 28 is brought to rest until a subsequent pick operation request is received by the processor unit 62.

It should be understood that deenergization of the solenoid 48 may be controlled by the processor unit 62 to occur on elapse of a predetermined time period after energization thereof, rather than in response to a signal from the sensor 72. This time period would be of sufficient duration to allow the belt 28 to be moved into engagement with the sheet 70 to be fed and for the sheet 70 to be separated from the stack 18 and moved into engagement with the first pair of feed rollers 56 of the transport system. This time is dependent on the speed of the belt 28 which in turn is dependent on the peripheral speed and, hence, the diameter of the drive pulley 26.

The note feeding apparatus of the present invention optimizes the tolerance of the belt 28 to wear since the belt 28 engages the stack of notes 18 only for the minimum time required to feed a note therefrom, and is then retracted until commencement of the next pick operation. The lifetime of the belt 28 is therefore increased and less frequent maintenance is required. The reliability of the picking is also improved, in particular toward the end of lifetime of the belt 28, since wear on the belt tends to be spread over its length as, in general, a different part of the belt 28 is brought into engagement with the stack 18 each time the solenoid 48 is energized. Moreover, since the belt 28 is continuously rotated from commencement of a pick operation until the desired number of notes have been picked, the feed rate capacity of the apparatus is not compromised.

Figure 4:
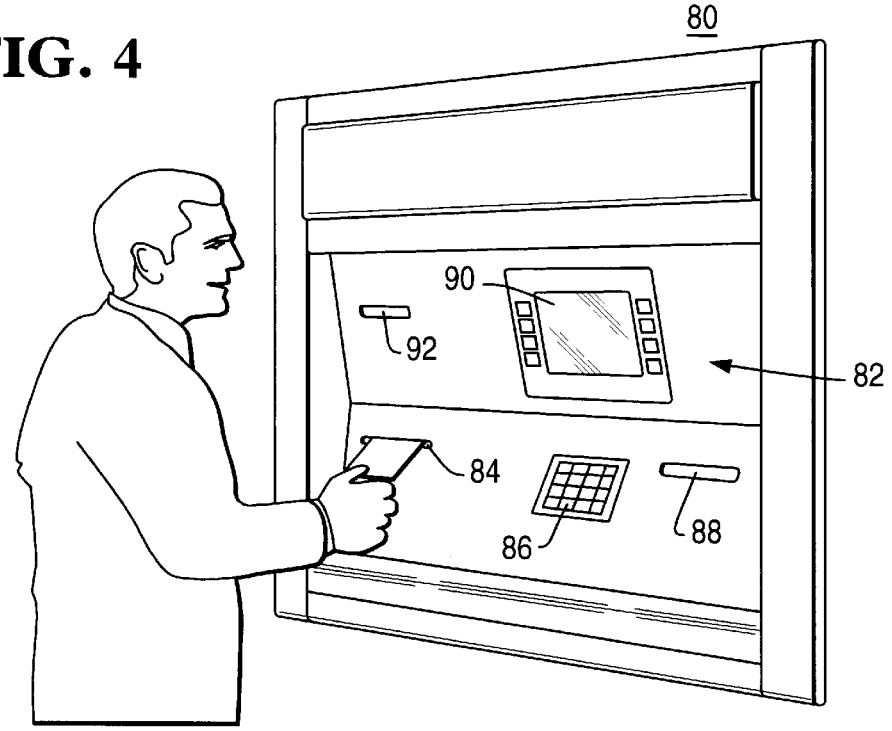
FIG. 4 is a external perspective view of an automated teller machine (ATM) in which the sheet feeding apparatus of FIGS. 1 to 3 may be used.

Referring now additionally to FIGS. 4 and 5, the note feeding apparatus described with reference to FIGS. 1 to 3 is used in a cash dispenser 88 of an automated teller machine (ATM) 80. The cash dispenser 88 would normally include more than one note feeding apparatus, each associated with a separate currency cassette 16. The ATM 80 includes a user interface on its front panel 82 and includes a card reader 84, a key pad 86, a cash dispenser 88, a CRT display screen 90, a receipt printer 92 and a control unit 60. The card reader 84, the cash dispenser 88 and the receipt printer 92 have associated slots located on the front panel 82 of the ATM 80, for insertion of a user's identifying card at the commencement of a transaction and for delivery of currency notes and a receipt to a user during a cash withdrawal transaction, respectively. The cash dispenser 88 includes the note feeding apparatus of FIGS. 1 to 3 ATM and stacking and transport mechanisms. The processor unit 62 controls operation of components of the front panel 82 and various other operating mechanisms of the ATM 80.

In a typical ATM cash withdrawal transaction, a user inserts his card into the card reader slot 84 and data encoded on the card is read. Instructions are then displayed on the screen 90. The user is requested to enter a personal identification number (PIN) on the key pad 86 which is verified, usually at a central location remote from the ATM 80. If the PIN is determined to be correct, a menu of the various facilities available to the customer is then displayed on the screen 90. If a cash withdrawal facility is selected, the customer is requested to enter the sum required on the key pad 86. This request is transmitted to the processor unit 62 as a pick operation request for the number of currency notes to be dispensed to the user. The note feeding apparatus of the cash dispenser 86 operates in the manner described above until the desired number of notes are picked from a currency cassette 16. The picked notes are fed by the feed rollers 56 of the transport mechanism of the cash dispenser 88 to a stacking mechanism (not shown) and are then delivered to the user through the cash dispenser slot in the front panel 82 of the ATM 80.

What is claimed is:

1. Apparatus for picking a sheet (70) from a stack (18), comprising:

a) an endless belt (28) supported by a pick pulley (26), and having i) a curved region adjacent the pick pulley (26) and ii) two flat regions extending away from the pick pulley (26); and b) means for advancing the pick pulley (26) into the stack (18), such that the curved region contacts the sheet (70), but not a flat region; and c) a retard roller (50) which cooperates with the pick pulley (26) to form a nip into which the sheet (70) is drawn after the contact of paragraph (b).

2. Apparatus according to claim 1, and further comprising:

d) an ATM machine which houses the elements of paragraphs (a), (b), and (c).

3. A method of extracting a sheet from a stack, comprising the following steps:

a) supporting an endless belt over a pick pulley near the stack;

b) moving the pick pulley against the stack, so that only a curved part of the belt touches the sheet;

c) rotating the pick pulley to thereby extract the sheet; and d) guiding the sheet into a nip between the pick pulley and a rotating retard roller which opposes extraction of the sheet.

4. Method according to claim 3, wherein all steps are undertaken within an ATM machine.

5. Apparatus for picking a sheet from a stack, comprising:

a) a pick roller;

b) a belt wrapped partially around the pick roller; and c) means for pinching a curved section of the belt between the pick roller and the stack; and d) a retard roller which cooperates with the pick roller to form a nip into which the sheet is drawn.

* * * * *